US006880995B2

(12) United States Patent
Cheng

(10) Patent No.: US 6,880,995 B2
(45) Date of Patent: Apr. 19, 2005

(54) ELASTIC-CUP SUPPORT FOR COMPUTER KEYBOARD

(75) Inventor: Tsung-Kan Cheng, Taipei (TW)

(73) Assignee: Monterey International Corp., Taipei (TW)

( * ) Notice: Subject to any disclaimer, the term of this patent is extended or adjusted under 35 U.S.C. 154(b) by 0 days.

(21) Appl. No.: 10/616,630

(22) Filed: Jul. 9, 2003

(65) Prior Publication Data

US 2005/0008419 A1 Jan. 13, 2005

(51) Int. Cl.[7] ..... B41J 5/16; H01H 13/70

(52) U.S. Cl. ..... 400/491.2; 400/495.1; 200/513

(58) Field of Search ..... 400/479, 490, 400/491, 491.1, 491.2, 491.3, 495, 495.1; 200/344, 200/345, 513

(56) References Cited

U.S. PATENT DOCUMENTS 5,842,798 A * 12/1998 Su ..... 400/491.2
6,064,020 A * 5/2000 Yamada et al. ..... 200/344
6,236,003 B1 * 5/2001 Suganami ..... 200/5 A
6,355,894 B1 * 3/2002 Miyakoshi ..... 200/344
6,541,724 B1 * 4/2003 Nozawa et al. ..... 200/517

* cited by examiner

*Primary Examiner*—Stephen R. Funk
(74) *Attorney, Agent, or Firm*—Pro-Techtor International Services

(57) ABSTRACT

An elastic-cup support for keyboard is in the form of a flat locating sheet located on a membrane-type switch circuit board of the keyboard, and provided at positions corresponding to membrane-type switches on the circuit board with receiving holes for separately receiving an elastic cup therein. Each of the receiving holes is provided with an upward projected wall portion to confine the elastic cup to the receiving hole. The wall portion is optionally provided with at least one notch having a lug radially inward extended therefrom, such that the elastic cup confined by the wall portion is also pressed against the at least one lug to fixedly located in the receiving hole on the flat locating sheet. Alternatively, the wall portion may be provided at an upper edge with at least one radially inward projected lug to prevent the elastic cup from separating from the receiving hole.

2 Claims, 11 Drawing Sheets

ELASTIC-CUP SUPPORT FOR COMPUTER KEYBOARD

FIELD OF THE INVENTION

The present invention relates to an elastic-cup support for computer keyboard, which allows a plurality of elastic cups to be independently, easily, and quickly mounted thereto and dismounted therefrom to largely reduce manufacturing and maintenance costs of the keyboard and effectively increase a good yield thereof.

BACKGROUND OF THE INVENTION

A keyboard is one of many input devices included in a computer configuration. A user uses fingers to depress keys on the keyboard to input data.

FIG. 1 is a schematic perspective view of a keyboard for a notebook computer, and FIG. 2 is a fragmentary and enlarged perspective view of the keyboard of FIG. 1 showing a structure of one single key thereof. As shown, the keyboard mainly includes a base on which a plurality of keys are provided. More specifically, the keyboard includes a sheet metal base 1, a membrane-type switch circuit board 2 located above the sheet metal base 1, a plurality of balancing mechanisms 3, a plurality of key caps 4, and a plurality of elastic cups 5.

The sheet metal base 1 serves as a mounting platform in the keyboard. There are a plurality of upward extended lower shaft holders 11 and lower slide ways 12 formed on the sheet metal base 1 for holding the balancing mechanisms 3 thereto. The base 1 may function equally well to hold the balancing mechanisms 3 when it is only provided with the lower shaft holders 11 or the lower slide ways 12.

The membrane-type switch circuit board 2 is located above the base 1 and includes a plurality of membrane-type switches 21 and connecting circuits 22.

Each of the balancing mechanisms 3 is an X-type balancing mechanism being provided at four outmost corners or other suitable positions with lower shafts 31 and/or lower lugs 32 for engaging with the lower shaft holders 11 and/or the lower slide ways 12, respectively, and upper shafts 33 and/or upper lugs 34 for engaging with upper shaft holders 41 and/or upper slide ways 42, respectively, correspondingly provided on the key cap 4. The balancing mechanism 3 keeps the corresponding key cap 4 in a balanced position when the key cap 4 is downward pushed, and normally locates the key cap 4 in place.

Each of the key caps 4 is provided at a lower surface with upper shaft holders 41 and upper slide ways 42 for engaging with the upper shafts 33 and the upper lugs 34, respectively, on the balancing mechanism 3. The key caps 4 may still be firmly held to the balancing mechanisms 3 even if the key caps 4 are provided with only the upper shaft holders 41 or the upper slide ways 42.

As can be seen from FIGS. 3 and 4, each of the elastic cups 5 is located between the membrane-type switch circuit board 2 and one of the key caps 4 to align with a center of a corresponding membrane-type switch 21. The elastic cup 5 has an elasticity and a cup-shaped configuration that provide a sufficient restoring force for the downward pushed key cap 4 to return to its original position before being depressed. The elastic cup 5 is provided at an inner top with a central stem 51, as can be seen from FIGS. 6 and 7. When a key cap 4 is depressed, the central stem 51 of the corresponding elastic cup 5 is moved downward to press against the corresponding membrane switch 21 to make it.

Please refer to FIG. 5 that is a perspective view of a conventional elastic-cup support 6 in the keyboard for locating the elastic cups 5 in place. The elastic-cup support 6 is a flat sheet having a plurality of locating openings 61 formed thereon at predetermined positions. The elastic cups 5 are separately mounted on the flat sheet of the elastic-cup support 6 in a non-detachable manner, so that the elastic cups 5 and the support 6 together form an elastic-cup assembly A. When the elastic-cup assembly A is sandwiched between the key caps 4 and the membrane-type switch circuit board 2, the locating openings 61 are used to locate the elastic-cup assembly A in place on the circuit board 2, so that each elastic cup 5 is aligned with a corresponding membrane-type switch 21.

The elastic-cup assembly A may be divided into two types according to the manner in which the elastic cups 5 are connected to the flat sheet of the elastic-cup support 6. In FIG. 6, the flat sheet 6 and the elastic cups 5 are made of the same type of rubber material through integral molding to form the elastic-cup assembly A. In FIG. 7, the flat sheet 6 and the elastic cups 5 are made of different types of materials and are separately produced. For example, the flat sheet 6 is formed at positions corresponding to the membrane-type switches 21 on the circuit board 2 with through holes 62. The elastic cups 5 are separately connected at a lower edge 52 to a circumferential edge of the through holes 62 by means of bonding agent 63 to form the elastic-cup assembly A. In either case, the elastic cups 5 are always an integral part of the flat sheet 6 and are not detachable therefrom.

In the course of manufacturing the elastic-cup assembly A, or in the course of using the keyboard, it is possible a certain one of the elastic cups 5 is improperly produced or damaged and requires replacement. In the conventional elastic-cup assembly A, either that shown in FIG. 6 or FIG. 7, since the elastic cups 5 are not detachable from the flat sheet of the elastic-cup support 6, any damaged or defective elastic cup 5 will make the whole elastic-cup assembly A unusable because it is impossible to remove only the damaged or defective elastic cup 5 from the elastic-cup support 6 and replace it with a good one. That is, the whole elastic-cup assembly A having a defective or damaged elastic cup 5 must be replaced with a new one. This would inevitably increase the bad yield in manufacturing the keyboard and form unnecessary waste of materials to increase the manufacturing cost.

SUMMARY OF THE INVENTION

A primary object of the present invention is to provide an elastic-cup support for computer keyboard to overcome the drawbacks existed in the conventional elastic-cup assembly.

To achieve the above and other objects, the elastic-cup support of the present invention includes a flat locating sheet located on a membrane-type switch circuit board of the keyboard, and provided at positions corresponding to membrane-type switches on the membrane-type switch circuit board with receiving holes for separately receiving an elastic cup therein. Each of the receiving holes is provided along a circumferential edge with an upward projected wall portion, such that the elastic cup received in each receiving hole is confined thereto by the wall portion. When the elastic cups are separately positioned in the receiving holes, they are automatically aligned with centers of the membrane-type switches. Moreover, the elastic cups are mutual-independently located in the receiving holes. Any damaged or defective elastic cup would not affect other elastic cups and may be individually replaced with a good one without the need of discarding the whole elastic-cup support and all the elastic cups mounted thereon. Therefore, the keyboard may be manufactured at largely reduced material and cost to effectively increase the good yield thereof.

The wall portion surrounding each receiving hole is optionally provided with at least one notch, and the notch may be optionally provided with a lug radially inward extended therefrom, such that the elastic cup confined by the wall portion is also pressed against the at least one lug to fix the elastic cup in the receiving hole on the flat locating sheet.

Alternatively, the wall portion of each receiving hole may be provided at an upper edge with at least one radially inward projected lug. While the at least one lug permits the elastic cup to pass therethrough and thereby mount in the receiving hole enclosed by the wall portion, the lug also effectively prevents the elastic cup from easily separating from the receiving hole. Therefore, the elastic cup mounted in the receiving hole is protected against easy separation therefrom.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
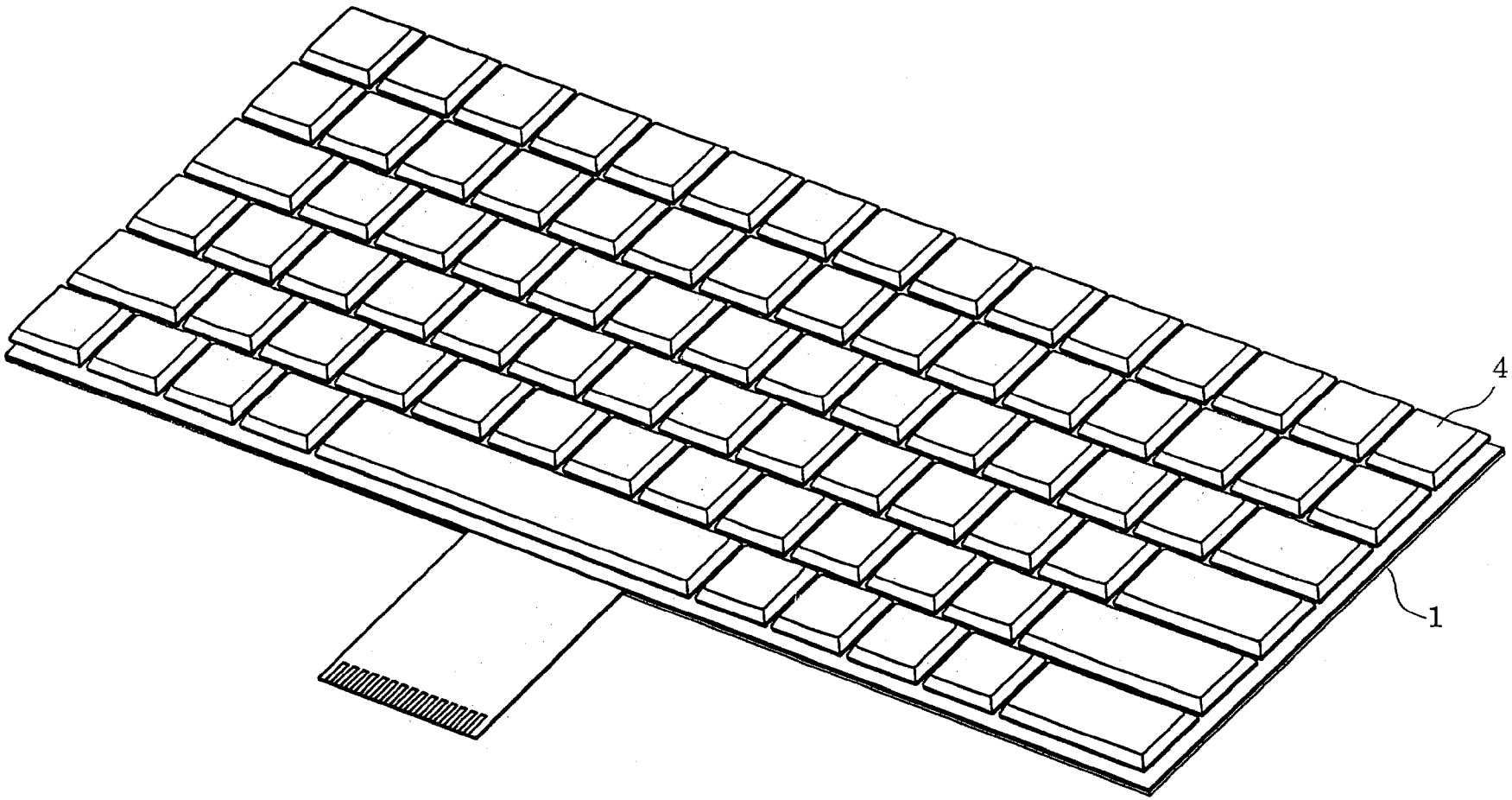
Fig. 1 (PRIOR ART)
FIG. 1 is a schematic perspective view of a general computer keyboard.
Figure 2:
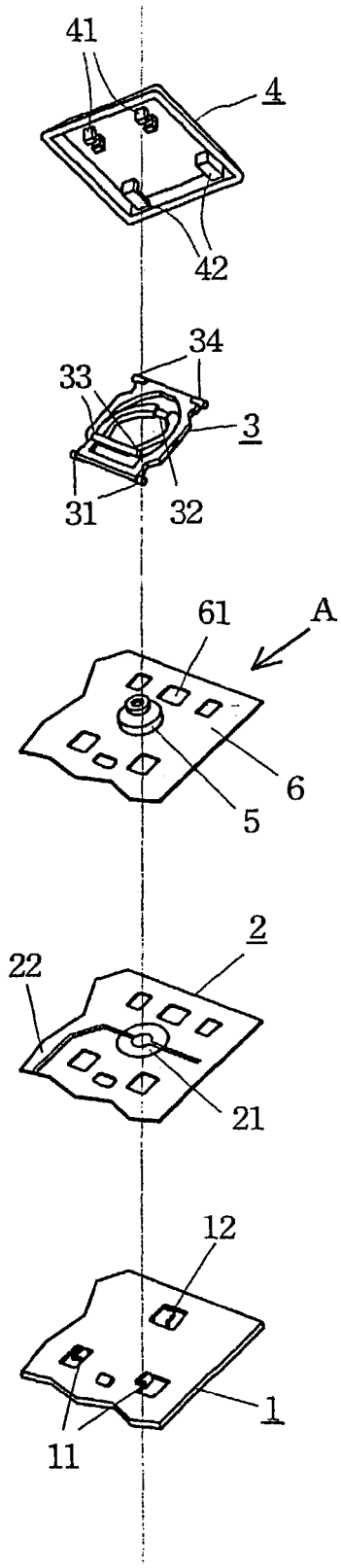
Fig. 2 (PRIOR ART)
FIG. 2 is a fragmentary exploded perspective view of the keyboard of FIG. 1 showing the structure of one single key thereof, in which a conventional elastic cup support is included.
Figure 3:
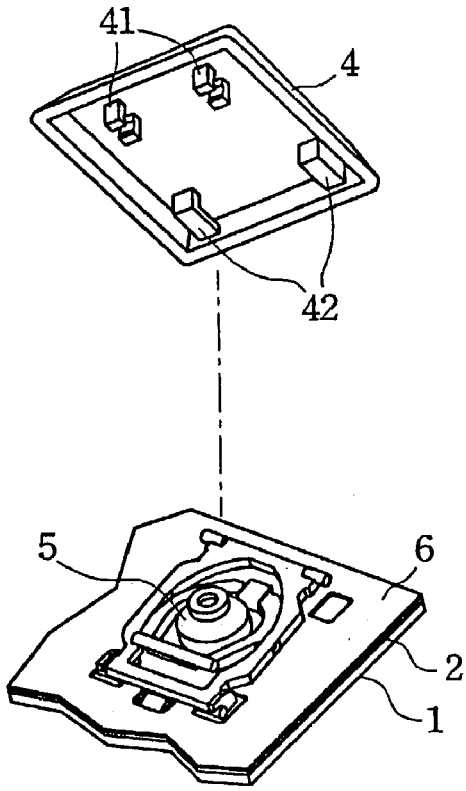
Fig. 3 (PRIOR ART)
FIG. 3 is a fully assembled perspective view of the key of FIG. 2.
Figure 4:
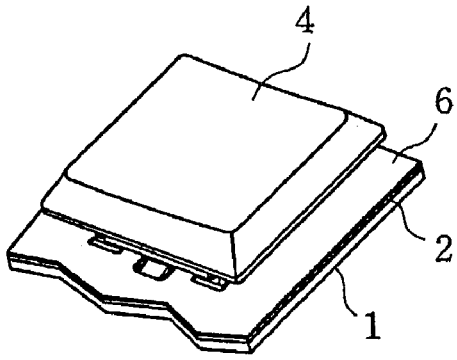
Fig. 4 (PRIOR ART)
FIG. 4 is a fully assembled perspective view of the key of FIG. 2.
Figure 5:
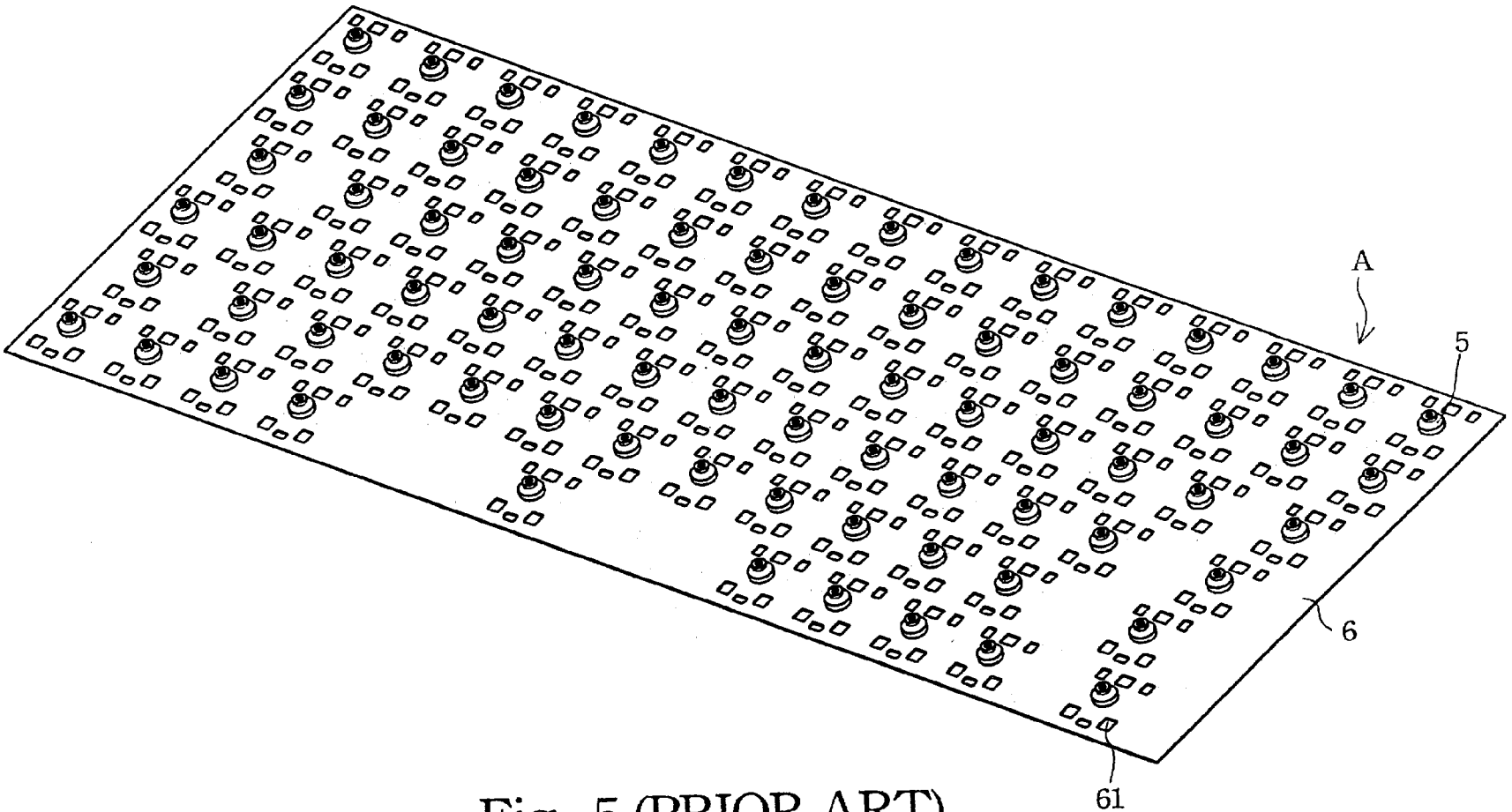
Fig. 5 (PRIOR ART)
FIG. 5 is a perspective view of a conventional elastic cup support included in the computer keyboard.
Figure 6:
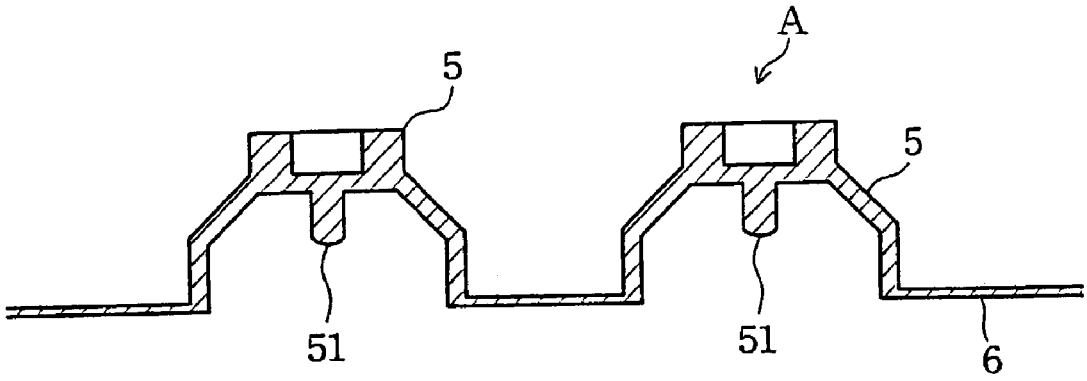
Fig. 6 (PRIOR ART)
FIG. 6 is a fragmentary sectional view of a first embodiment of the conventional elastic cup support of FIG. 5.
Figure 7:
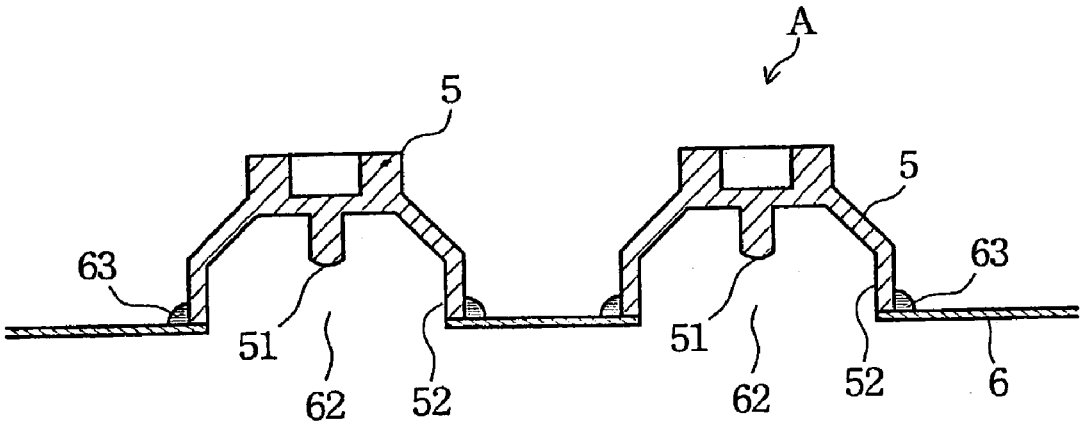
Fig. 7 (PRIOR ART)
FIG. 7 is a fragmentary sectional view of a second embodiment of the conventional elastic cup support of FIG. 5.
Figure 8:
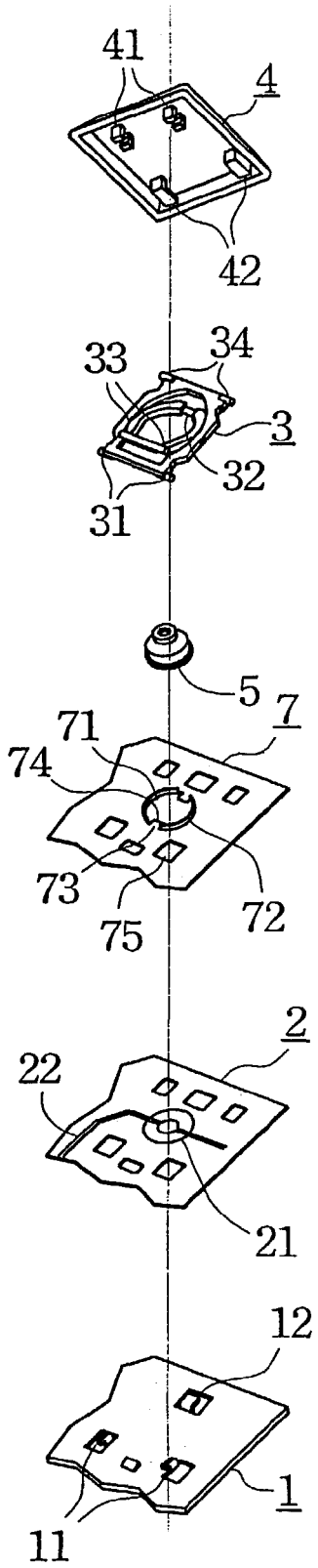
FIG. 8 is a fragmentary exploded perspective view of a keyboard showing the structure of one single key thereof, in which an elastic cup support according to an embodiment of the present invention is included.

Please refer to FIG. 8 that is a fragmentary exploded perspective view of a keyboard showing the structure of one single key thereof, in which an elastic cup support according to an embodiment of the present invention is included. As shown, the keyboard is generally structurally similar to that of FIG. 2 and includes a sheet metal base 1, a membrane-type switch circuit 2, a plurality of balancing mechanisms 3, a plurality of key caps 4, and a plurality of elastic cups 5. However, the keyboard of FIG. 8 includes an elastic-cup support 7 that is structurally different from the elastic-cup support 6.

The elastic-cup support 7 is in the form of a flat locating sheet 7 located on the membrane-type switch circuit board 2, and is provided at positions corresponding to membrane-type switches 21 of the circuit board 2 with receiving holes 71. Each of the receiving holes 71 is provided along a circumferential edge with an upward extended wall portion 72. The wall portion 72 is not necessarily continuously extended, and may have at least one notch 73. A radially inward extended lug 74 may be provided at each notch 73.

The flat locating sheet 7 also includes a plurality of locating openings 75 to enable the flat sheet 7 to correctly locate on the membrane-type circuit board 2 with the receiving holes 71 separately aligned with the membrane-type switches 21.

Figure 9:
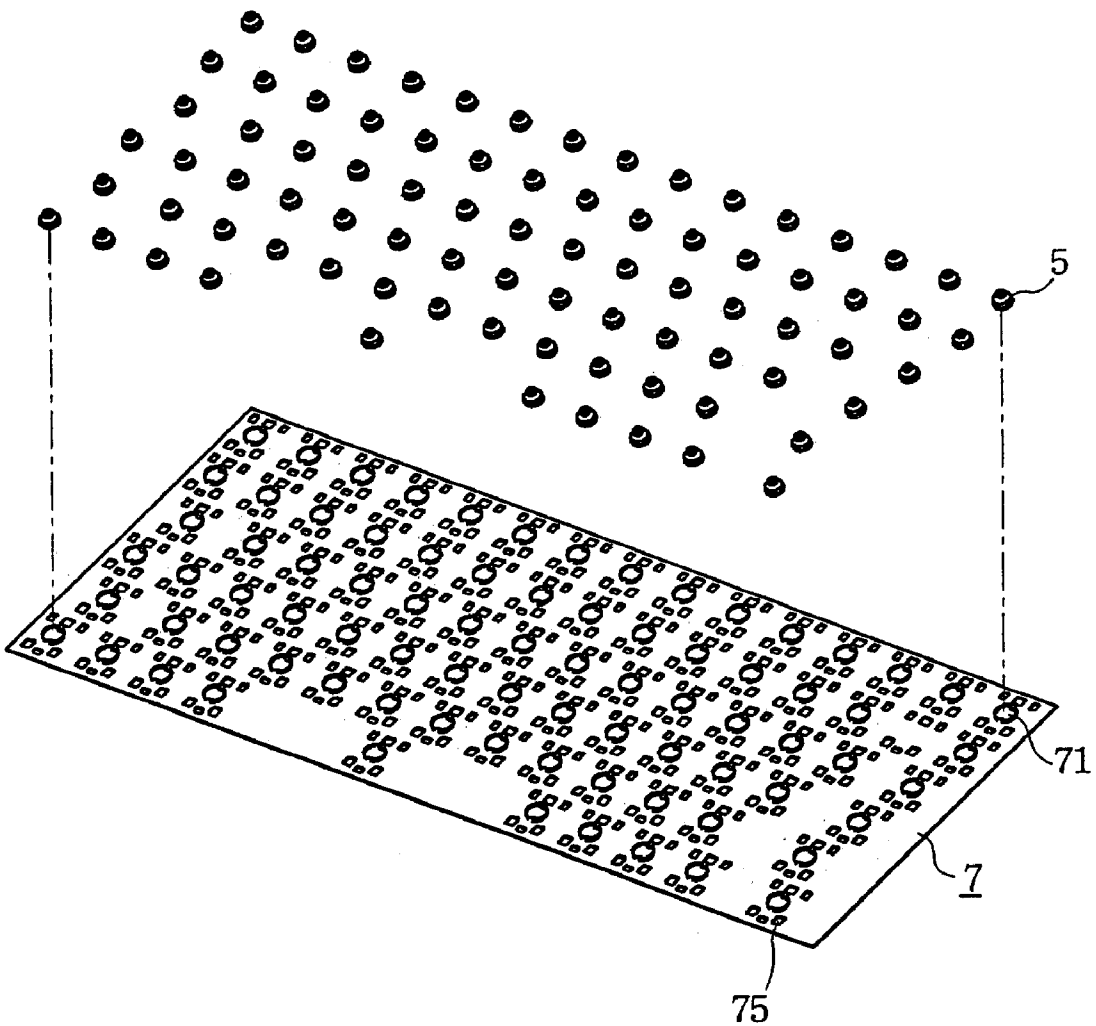
FIG. 9 is a perspective view of the elastic cup support shown in FIG. 8.

In assembling the keyboard of FIG. 8, the elastic cups may be easily positioned in the receiving holes 71 on the flat locating sheet 7 and located in place, as shown in FIG. 9. The wall portion 72 surrounding each receiving hole 71 confines the corresponding elastic cup 5 to the receiving hole 71 to align with the center of the corresponding membrane-type switch 21 which prevents the elastic cup 5 from separating from the receiving hole 71. It is to be noted that the elastic cups 5 confined by the wall portion 72 to the receiving holes 71 are not integrally connected to the receiving holes 71 but can be independently removed therefrom. That is, in the event a certain one of the elastic cups 5 is damaged or defective, it does not prevent other elastic cups 5 from functioning normally. Therefore, any defective or damaged elastic cup 5 found in the course of manufacturing or in the service life of the keyboard, the defective or damaged elastic cup 5 may be dependently removed and replaced with a good one without the necessity of discarding the whole elastic-cup support 7 and other normal elastic cups 5. This enables saving of a large quantity of material for making the keyboard and to effectively upgrade the good yield of the keyboard.

Figure 10:
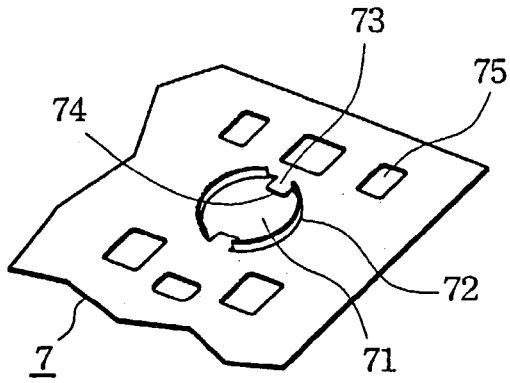
FIG. 10 is a fragmentary and enlarged perspective view showing the structure of the elastic cup support of FIG. 9 according to a first embodiment thereof.
Figure 11:
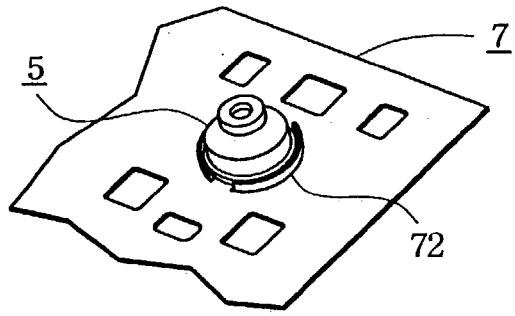
FIG. 11 shows the elastic cup support of FIG. 10 having an elastic cup mounted thereto.
Figure 12:
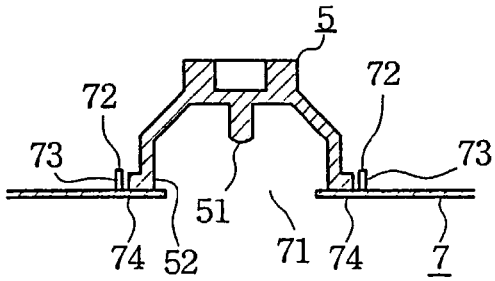
FIG. 12 is an enlarged sectional view of FIG. 11.

FIGS. 10, 11, and 12 show a first embodiment of the receiving holes 71 of the elastic-cup support 7. In this first embodiment, the wall portion 72 of each receiving hole 71 has two notches 73, and both notches 73 have a radially inward extended lug 74. In a fully assembled keyboard, each key cap 4 would press against the corresponding elastic cup 5, so that the elastic cup 5 confined by the wall portion 72 to the receiving hole 71 has a lower edge in contact with and supported on the lugs 74. In this manner, the elastic cups 5 are fixedly located on the flat locating sheet 7.

Figure 13:
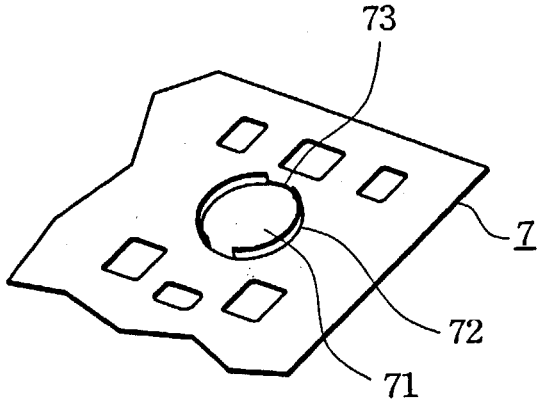
FIG. 13 is a fragmentary and enlarged perspective view showing the structure of the elastic cup support of FIG. 9 according to a second embodiment thereof.
Figure 14:
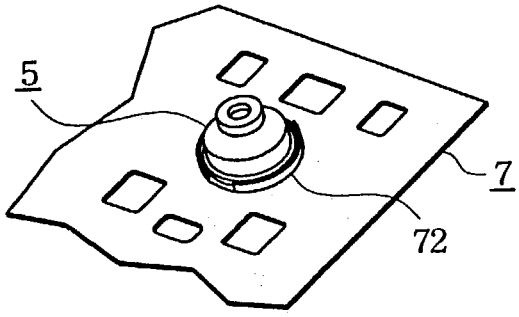
FIG. 14 shows the elastic cup support of FIG. 13 having an elastic cup mounted thereto.
Figure 15:
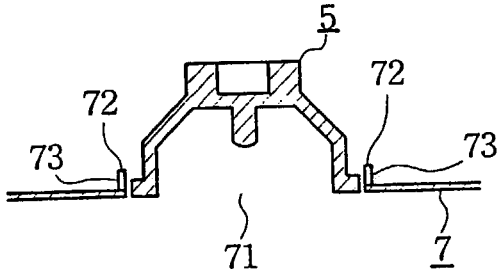
FIG. 15 is an enlarged sectional view of FIG. 14.
Figure 16:
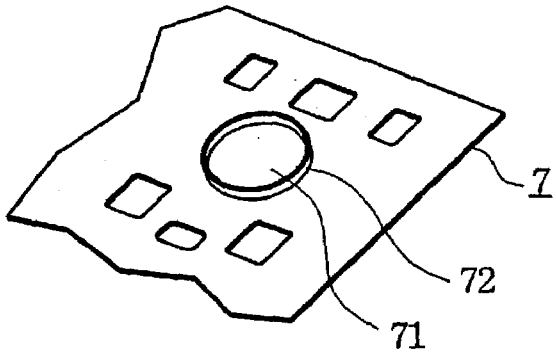
FIG. 16 is a fragmentary and enlarged perspective view showing the structure of the elastic cup support of FIG. 9 according to a third embodiment thereof.
Figure 17:
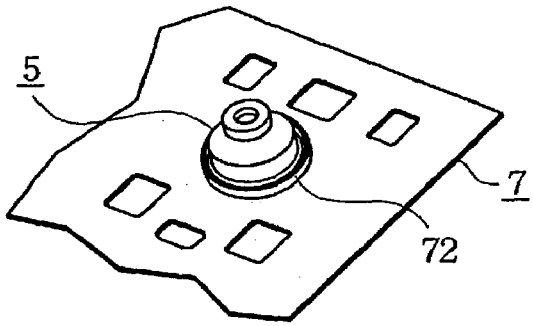
FIG. 17 shows the elastic cup support of FIG. 16 having an elastic cup mounted thereto.
Figure 18:
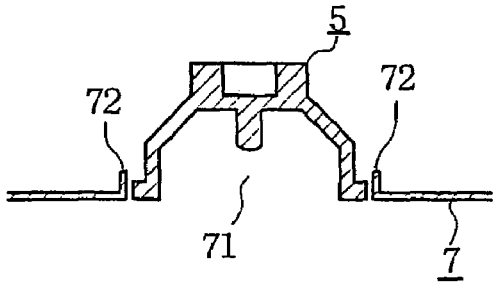
FIG. 18 is an enlarged sectional view of FIG. 17.

FIGS. 13, 14, and 15 show a second embodiment of the receiving holes 71 of the elastic-cup support 7. In this second embodiment, the wall portion 72 of each receiving hole 71 has two notches 73, but neither notch 73 has a radially inward extended lug 74. FIGS. 16, 17, and 18 show a third embodiment of the receiving holes 71 of the elastic-cup support 7. In this third embodiment, the wall portion 72 of each receiving hole 71 is continuously extended without any notch 73 and lug 74. Although the continuous wall portion 72 does not have any notch and lug provided thereat, the elastic cup 5 may still be directly and independently positioned in the receiving hole 71 and be located in place by the continuous wall portion 72. An advantage of the wall portion 72 with notches 73 is it can be more easily manufactured than the continuous wall portion 72.

Figure 19:
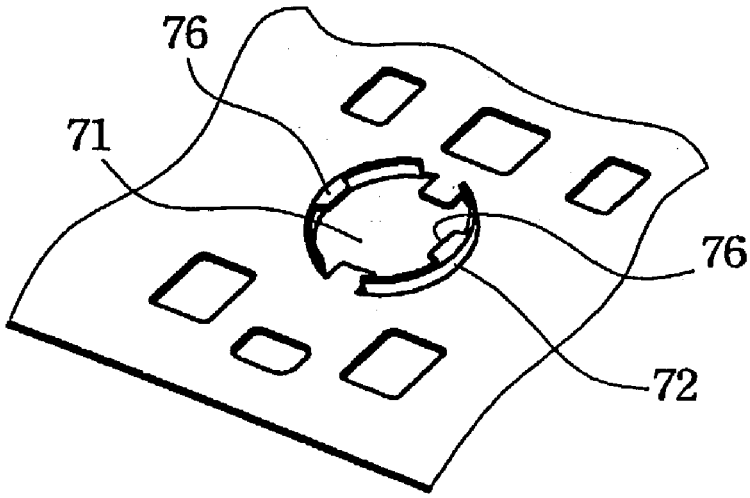
FIG. 19 is a fragmentary and enlarged perspective view showing the structure of the elastic cup support of FIG. 9 according to a fourth embodiment thereof.
Figure 20:
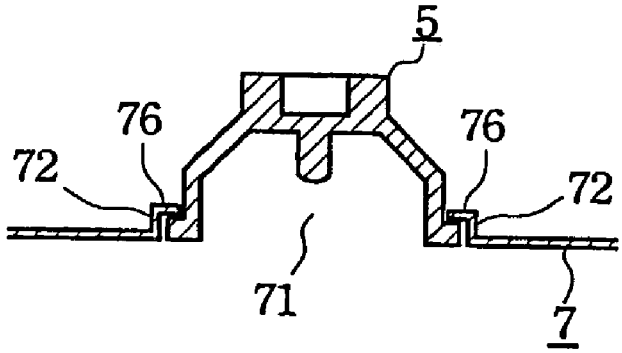
FIG. 20 is an enlarged sectional view showing the elastic cup support of FIG. 19 with an elastic cup mounted thereto.

FIGS. 19 and 20 shows a fourth embodiment of the receiving holes 71 of the elastic-cup support 7. In this fourth embodiment, the wall portion 72 of each receiving hole 71 is provided at an upper edge with at least one radially inward projected lug 76. While the at least one lug 76 permits the elastic cup 5 to pass therethrough and thereby mount in the receiving hole 71 enclosed by the wall portion 72, the lug 76 also effectively prevents the elastic cup from easily separating from the receiving hole 71. Therefore, the elastic cup 5 assembled to the receiving hole 71 is protected against easy separation therefrom.

In conclusion, the present invention provides an elastic-cup support for a computer keyboard. The elastic-cup support is in the form of a flat locating sheet having a plurality of receiving holes provided thereon at predetermined positions. Each receiving hole is surrounded by a wall portion with or without notches and/or lugs for confining the elastic cup to the receiving hole without the risk of easily separating from the elastic-cup support. The elastic cups are mutual-independently mounted on the elastic-cup support and can therefore be individually replaced, if necessary, to reduce the bad yield and manufacturing cost of the keyboard.

What is claimed is:

1. An elastic-cup support in combination with a computer keyboard comprising:

a keyboard comprising a sheet metal base having a plurality of upward extended lower shaft holders and lower slide ways formed thereon;

a membrane-type switch circuit board located above said sheet metal base and having a plurality of membrane-type switches and connecting circuits provided thereon;

a plurality of x-type balancing mechanisms being provided with lower shafts and/or lower lugs for engaging with said lower shaft holders and/or said lower slide ways on said base, said balancing mechanisms also being provided with upper shafts and/or upper lugs;

a plurality of key caps, each said key cap having on a lower surface upper shaft holders and/or upper slide ways for engaging with said upper shafts and/or said upper lugs on a corresponding one of said balancing mechanisms; and a plurality of elastic cups separately located between said key caps and said membrane-type switch circuit board and each having a central stem extended downward from an inner bottom thereof; wherein said elastic-cup support comprises a flat locating sheet located on said membrane-type switch circuit board, said locating sheet having at positions corresponding to said membrane-type switches on said membrane-type switch circuit board receiving holes for separately receiving one said elastic cup therein, each of said receiving holes being provided along a circumferential edge with an upward projected wall portion, such that said elastic cup receiving in each said receiving hole is confined thereto by said wall portion, each of said wall portions including at least one notch, each said notch on each of said wall portions is provided with a radially inward extended lug.

2. The elastic-cup support for computer keyboard as claimed in claim 1, wherein each of said wall portions is provided at an upper edge with at least one radially inward projected lug.

* * * * *